US008087576B2

(12) United States Patent
Steyerberg et al.

(10) Patent No.: US 8,087,576 B2
(45) Date of Patent: Jan. 3, 2012

(54) DATA STORAGE DEVICE AND METHOD FOR DETERMINING THE DEPENDENCY OF THE RISK FOR PROSTATE CANCER, DEVICE AND METHOD FOR INDICATING A RISK FOR A DISEASE OF AN INDIVIDUAL

(75) Inventors: Ewout Steyerberg, Rotterdam (NL); Monica Joanne Roobol-Bouts, Rotterdam (NL); Marinus Kranse, Rotterdam (NL); Fritz Heinrich Schröder, Oostvoorne (NL)

(73) Assignee: Stichting Wetenschappelijk Onderzoek Prostaatkanker (SWOP), Oostvoorne (NL)

( * ) Notice: Subject to any disclaimer, the term of this patent is extended or adjusted under 35 U.S.C. 154(b) by 629 days.

(21) Appl. No.: 12/160,916

(22) PCT Filed: Jan. 20, 2006

(86) PCT No.: PCT/NL2006/000031

§ 371 (c)(1),
(2), (4) Date: Nov. 19, 2008

(87) PCT Pub. No.: WO2007/083992

PCT Pub. Date: Jul. 26, 2007

(65) Prior Publication Data

US 2009/0212551 A1 Aug. 27, 2009

(51) Int. Cl.
*G06C 27/00* (2006.01)

(52) U.S. Cl. ..... 235/78 R; 235/66; 235/84

(58) Field of Classification Search ..... 235/78 R, 235/88 R, 66, 84

See application file for complete search history.

(56) References Cited

U.S. PATENT DOCUMENTS 3,255,961 A * 6/1966 Cumberpatch ..... 235/78 N
3,757,092 A * 9/1973 Miller ..... 235/74
3,821,521 A * 6/1974 Riehle ..... 235/119

(Continued)

FOREIGN PATENT DOCUMENTS

GB 1517976 A 7/1978

(Continued)

OTHER PUBLICATIONS

Roobol-Bouts, M.J., "Prostate cancer screening—Tests and algorithms", Doctoral Thesis, Department of Urology of the Erasmus Medical Centre, Rotterdam, the Netherlands, European Randomized study of Screening for Prostate Cancer (ERSPC), Dec. 21, 2005, pp. 1-171.

(Continued)

*Primary Examiner* — Daniel Hess
(74) *Attorney, Agent, or Firm* — Pearne & Gordon LLP

(57) ABSTRACT

A data storage device comprises a memory in which a collection of prostate cancer screening data is stored. The screening data is obtained from a selection of the general male population without medical pre-selection. A device for indicating a risk for a disease of an individual, comprises an indicator for indicating a determined value for said risk. The indicator comprises a risk scale representing a range of values of said risk, and at least one dialler for entering a value of a diagnostic parameter of an individual. The dialler comprises a parameter scale representing a range of values of said diagnostic parameter. The dialler is movable with respect to said indicator such that when a parameter value on said parameter scale is selected, an associated risk value is indicated on said risk scale according to a predetermined mathematical relationship.

13 Claims, 4 Drawing Sheets

U.S. PATENT DOCUMENTS

| | | | | |
|---|---|---|---|---|
| 4,117,315 | A * | 9/1978 | Ampt et al. | 235/88 R |
| 4,313,054 | A * | 1/1982 | Martini | 235/78 R |
| 4,855,577 | A * | 8/1989 | McLain | 235/78 N |
| 6,769,602 | B1 * | 8/2004 | Rottem | 235/88 RC |
| 7,637,418 | B2 * | 12/2009 | Craig | 235/88 RC |

FOREIGN PATENT DOCUMENTS

| | | | |
|---|---|---|---|
| WO | WO9712247 | A | 4/1997 |
| WO | WO03102855 | A | 12/2003 |

OTHER PUBLICATIONS

Etzioni, et al, "Serial Prostate Specific Antigen Screening for Prostate Cancer: A Computer Model Evaluates Competing Strategies", Journal of Urology, vol. 162, No. 3, Sep. 1999, Baltimore MD, pp. 741-748.

Moore, et al., "Image Quality Assurance in the Prostate, Lung, Colorectal, and Ovarian Cancer Screening Trial Network of the National Lung Screening Trial", Journal of Digital Imaging Springer-Verlag USA, vol. 18, No. 3, Sep. 2005, pp. 242-250.

Grant, et al., "Integrating Evidence and Data Into Decision Models for Ongoing Technology Evaluation", Proceedings of the American Medical Informantics Association Annual Symposium, Nov. 9, 2002, p. 1031.

* cited by examiner

DATA STORAGE DEVICE AND METHOD FOR DETERMINING THE DEPENDENCY OF THE RISK FOR PROSTATE CANCER, DEVICE AND METHOD FOR INDICATING A RISK FOR A DISEASE OF AN INDIVIDUAL

FIELD AND BACKGROUND OF THE INVENTION

The invention relates to a data storage device which can be used to establish a risk analysis procedure for prostate cancer, a method for determining a dependency of risk for prostate cancer, and to a device for indicating risk for prostate cancer to an individual. The invention further relates to a device for indicating risk for a disease of an individual. The invention further relates to a method for indicating risk for a disease of an individual.

In the art of medicine, prevention of diseases is desirable because this may reduce suffering and costs compared to curing diseases. Accordingly, screening programs, such as for breast cancer, have been established with the purpose of diagnosing and, optionally, treating a person carrying a disease before this person actually becomes ill.

A disadvantage of these screening programs is that they require performing medical tests on the individual involved. Due to the inherent shift to the diagnosis in earlier stages, the screening programs lead to overdiagnosis, i.e. persons being tested positive and hence being treated while in fact no threatening disease is present.

Although databases are known which allow a determination of the risk for diseases such as prostate cancer, these do not provide a reliable estimate of the risk for various reasons. This lack of reliability causes an unnecessary amount of medical tests and eventually treatments in individuals with in fact only a small risk of ever experiencing the symptoms or dying of the disease. Another disadvantage of the known methods to determine the risk, is that an individual cannot determine this risk of being susceptible to the disease by himself, but has to consult medical expert knowledge.

SUMMARY OF THE INVENTION

It is a goal of the invention to provide a device which can be used by a person to determine a risk of suffering from a disease by himself in a simple manner. Therefore, according to the invention, a device according to claim 1 is provided. Such a device allows determination by the individual himself in a simple manner by merely moving the at least one dialler in the correct position and perceiving the thus indicated chance of having the disease. Also, such a device can be manufactured with low costs, for example of paper or other sheet materials. Furthermore a method according to claim 18 is provided.

It is a further goal of the invention, to improve the reliability of the assessment of risk. Therefore, according to another aspect of the invention, a data storage device according to claim 20 is provided. By using the data stored in such a device, the reliability of the risk assessment is improved, because the data is collected from the general population without medical pre-screening of the selection, and because the available data also allows to determine the risk of a cancer once the diagnosis has been established. Also, the data storage device allows to establish a procedure or implement a device which balances the potential advantages of early diagnosis and the identification of indolent cases of prostate cancer. Accordingly, a dependency of risks on diagnostic parameters determined with this data will more accurately resemble reality.

Furthermore a method according to claim 23 is provided Specific embodiments of the invention are set forth in the dependent claims.

BRIEF DESCRIPTION OF THE DRAWINGS

Further details, aspects and embodiments of the invention will be described, by way of example only, with reference to the drawings.

DETAILED DESCRIPTION

Figure 1:
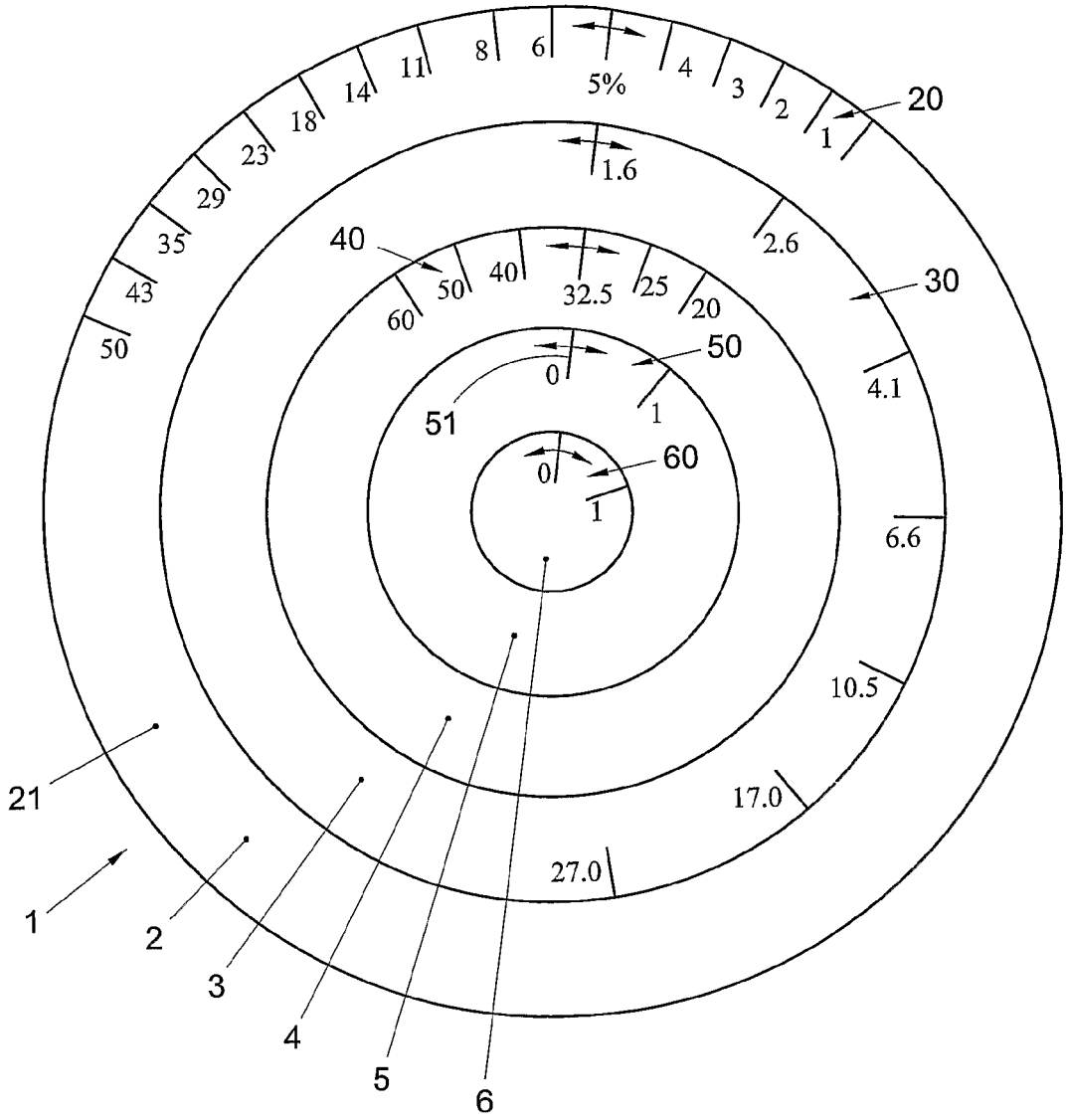
FIG. 1 schematically shows first example of an embodiment of a device according to the invention.
Figure 2:
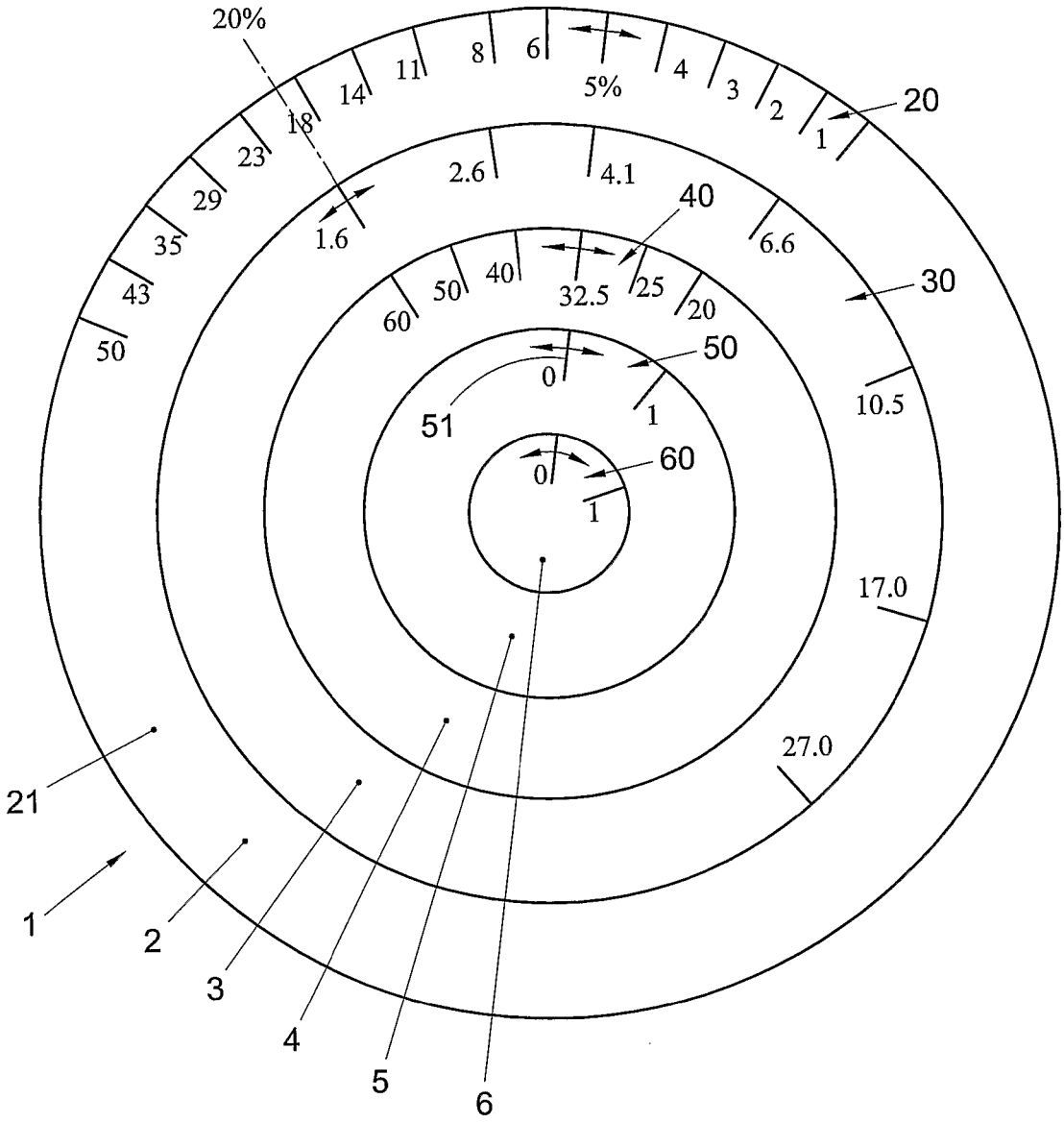
FIG. 2 schematically illustrates a first prediction with the example of FIG. 1.
Figure 3:
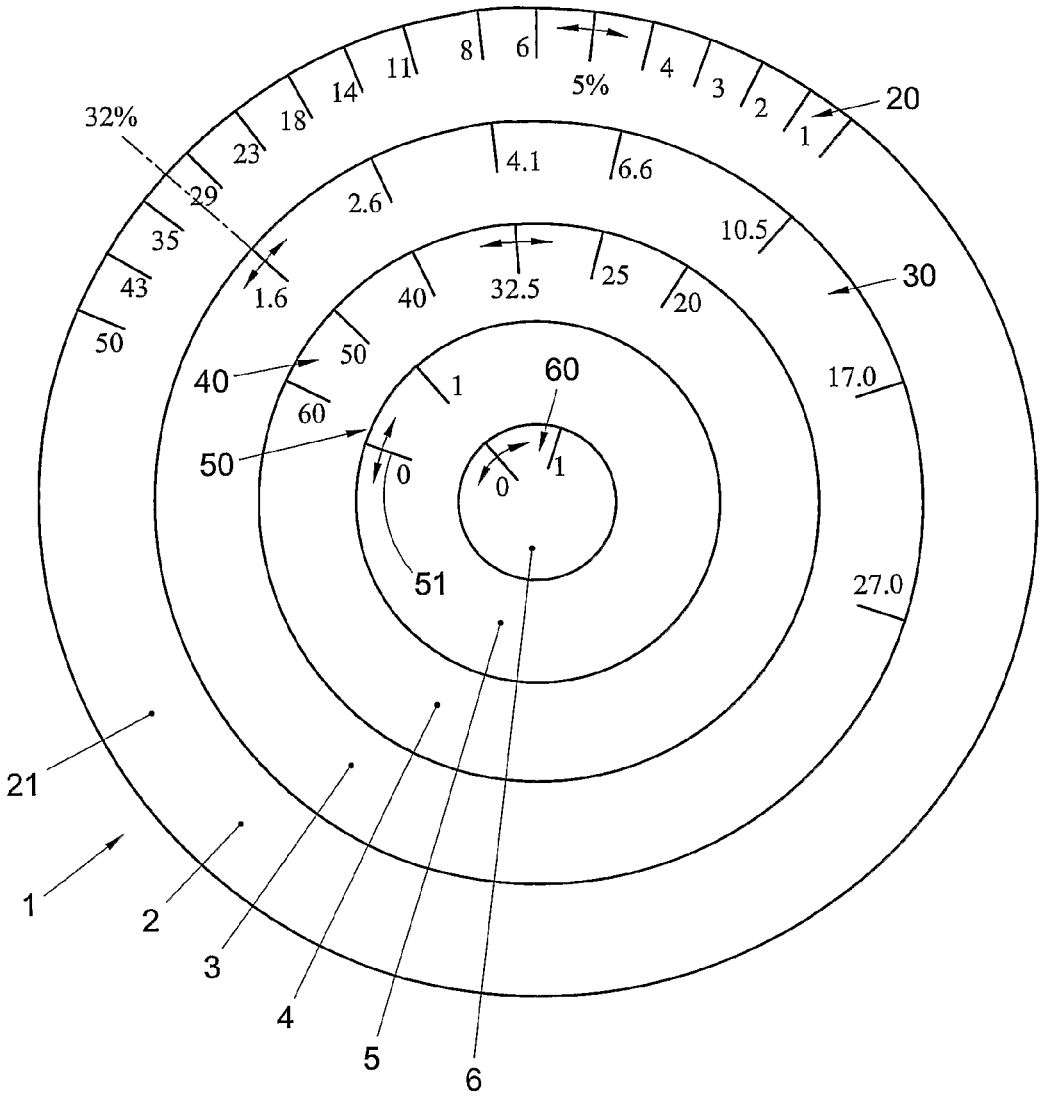
FIG. 3 schematically illustrates a second prediction with the example of FIG. 1.

In the examples of FIGS. 1-3, a device 1 for indicating a risk for a disease of an individual is shown. The device, as explained below in more detail, may for example be used by men who consider opportunistic early detection measures and who are concerned about the risk of having the disease they are wondering about.

The device 1 includes an indicator 2 for indicating a determined value for the risk. The indicator 3 comprises a risk scale 20 representing a range of values of the risk. In this example, the risk is indicated as a percentage representing the chance on to die from prostate cancer. However, the risk may also represent another chance, such as suffering from a disease or being a carrier of the disease. The device 1 further has one or more diallers 3-6 for entering a value of a diagnostic parameter of an individual. Each of the diallers comprises a parameter scale 30-60 representing a range of values of the respective diagnostic parameter. The diallers 3-6 are each movable with respect to the indicator 2 such that, when a parameter value on the respective parameter scale 30-60 is selected, an associated risk value is indicated on the risk scale 20 according to a predetermined mathematical relationship.

The device 1 may comprise any suitable number of diallers, such as two or more diallers 3-6, of which a first dialler 3 comprises a parameter scale 30 representing a range of values of a first diagnostic parameter. A second dialler 4 comprises a parameter scale 40 representing a range of values of a further diagnostic parameter. The second dialler 4 is movable with respect to the indicator 2 such that when a parameter value on the parameter scale 40 is selected, the range of values for the risk to be indicated upon entering a value with the first dialler is reduced.

In the examples of FIGS. 1-3, for example, the risk is indicated by setting successive diallers 3-6 in a position to be determined by the user. When a parameter value is selected, the corresponding point on the parameter scale 30-60 of the respective dialler 3-6 is set to the same position as a predetermined point of the successive parameter scale, in this example corresponding to a calibration value of the parameter. E.g. in the example of FIG. 1, parameter values "0" are selected for the two most inner diallers representing parameters 'DRE' and 'TRUS'. Thereafter the value for the successive parameter is selected.

The parameter scale may for instance be a continuous scale representing a continuous parameter, such as the level of a compound in a body fluid. The scale may also be a binary scale, e.g. representing a 'yes' or 'no', for example to select whether or not the individual has been subjected to a certain type of examination. For instance, in the example of FIGS. 1-3, the parameter scales labelled 'DRE' and 'TRUS' are binary scales, which may be set to either the values 0 or 1 to indicated whether or not prostate abnormalities were found in the individual by a direct rectal examination (DRE) or transrectal ultrasound examination (TRUS).

In the example of FIGS. 1-3, the device 1 is shown in initially calibrated, as shown in FIG. 1 in a calibration state in which 'normal' values of the parameters for a healthy individual are selected and alligned at the same circumferential position. In this example, normal values are set to 0 for DRE and TRUS, respectively, and a prostate volume of 32.5 ml, a PSA level of 1.6/ml and the resulting chance of being diagnosed with prostate cancer after a sextant prostate biopsy is 5%.

In the example of FIG. 2, the individual has been subjected to DRE and TRUS, but no abnormalities were determined, but a PSA level of 4.1 has been found. Hence, the parameter scales 50 and 60 have been set to 0, and the parameter scale 40 representing prostate volume remains, compared to FIG. 1, at the same parameter value. The dialler 3 is rotated such that the parameter scale 30, representing PSA level, is positioned with the measured level, 4.1, circumferentially at the same position as the calibration value on the parameter scale 30, while the outer dialler 2 remains, with respect to the not-rotated diallers 4-6 in the same position. The resulting risk is indicated at the 1.6 calibration point on the parameter scale 30 of the dialler 3 directly adjacent to the risk scale 20, and is about 20%.

In the example of FIG. 3, the outer dialler 2 remains in the same position compared to FIGS. 1 and 2, but parameter scales 50 and 60 are set to '1', without rotation of the outer dialler 2, thus indicating that abnormalities in the prostate of the person were found by DRE and TRUS, respectively. The dialler 4 representing prostate volume is rotated relative to the outer dialler 2 and the more inner diallers 5 and 6 such that the point corresponding to the measured prostate volume of 60 ml in circumferential direction coincides with the calibration value '0' on the directly adjacent more inner dialler 5. Thereafter, the dialler 3 representing PSA level is rotated relative to the outer dialler 2 and to the more inner dialers 4-6, such that the point corresponding to the measured level of 4.1 coincides in circumferential direction with the calibration value of 32.5 on the directly adjacent more inner dialler 4. The resulting risk is indicated at the 1.6 calibration point on the parameter scale 30 of the dialler 3 directly adjacent to the risk scale 20, and is about 32%.

The device 1 shown in FIGS. 1-3 can be used to perform a risk analysis for prostate cancer or another disease on the basis of one or more diagnostic parameters in which a prediction model is followed. In such a model, a prediction about a risk is made after determining a value of one or more diagnostic parameters in a sequential order. E.g. after a prediction is made about the risk, a suitable type of successive diagnostic parameter is determined and a prediction is made based on the value of the successive parameter. At the end of this sequential prediction process, the risk of a disease is indicated in % probability.

For instance in the example of FIG. 1, the parameter scale 60 of the most inner dialler 6 is set in a position with respect to the dialler 5, which in a radial direction from the inside to the outside is successive to the most inner dialler 6. In this position the point on the parameter scale 60 representing the selected parameter value is set to coincide with a predetermined point 51 of the parameter scale 50 of the successive dialler 5, in this example corresponding to the calibration value. After the most inner dialler 6 is set into a suitable position, these steps may be repeated with the successive dialler 5 with respect to the dialler 4 next to the successive dialler 4 until the, in said radial direction, most outer dialler 1 is set in position. By determining the value on the risk scale 20 at the same position as the value on the parameter scale 20 of the dialler next to the most outer dialler 1, the risk can be derived.

The indicator 2 and the diallers 3-6 may be implemented in any manner suitable for the specific implementation. The indicator 2 may for instance, as shown in FIG. 1 include a sheet-like body 21 provided with a for humans perceptible marking representing the risk scale 20. Thereby, a device 1 of simple construction can be obtained which can be manufactured in a simple manner, e.g. by cutting a sheet of suitable material, such as paper or cardboard into a desired shape and printing the risk scale.

The dialler(s) 3-6 may for example be slidable or rotatable with respect to the risk marking 20 in parallel to the plane of the sheet-like body 21, e.g. to position, as explained above, the parameter scale as desired. In the example of FIG. 1, for instance, the device 1 includes an number of larger annular sheet-like bodies, each enclosing an open, inner disk-shaped area in which at least one smaller annular sheet-like body is present. The annular sheet-like bodies are rotatably mounted with respect to each other around a central axis of the smaller annular body for selecting the parameter value. For example the diallers 3-6 may be fastened by a pin or other rotation element to the sheet-like body, to allow a rotation of the diallers around the rotational axis defined by the position of the rotation element.

The device 1 may for example be arranged to indicate the risk of prostate cancer. Also, the device 1 may be arranged to indicate the risk to a specific type of prostate cancer, such as the chance of the occurrence of an aggressive or a non-aggressive (prostate) cancer. The diagnostic parameter may be any parameter related to the risk of prostate cancer and for example comprise one or more of the group consisting of: age, family history of the disease, diet, smoking habits, skin colour (black versus Caucasian race), weight, weight change or a parameter associated with defecation and/or urination. Also, the diagnostic parameter may comprise a blood parameter such as a tumor associated antigen, e.g. PSA, concentration, the volume of the prostate determined by ultrasound, a biopsy parameter and/or manual probing parameter. However, the diagnostic parameter may also comprise a parameter of other body fluids, such as of body liquids (like urine or saliva) or gasses such as air breathed out by the respective person. Also, the diagnostic parameter may also comprise a parameter of body tissue, such as of histologic tissue.

However, it should be noted that the device may also be used to indicate the risk of another type of disease and include diallers representing suitable diagnostic parameters for the type of disease to be indicated. The disease may for example comprise bladder cancer, kidney cancer, and/or other urological malignancies. Likewise, the diagnostic parameter may be any parameter related to the risk of the respective disease.

The device 1 in the example of FIGS. 1-3, may be arranged to indicate the risk of a disease, e.g. prostate cancer, for an individual not examined medically for the disease. This may for example a male of age 55 or higher who has never been medically examined and who is worried about prostate cancer. The diallers 3-6 may then for example represent diagnostic parameters which can be determined by the interested individual himself, such as age, urinary complaints, and family history. The risk scale may then represent the probability that screening with a predetermined indication for prostate biopsy will detect prostate cancer The device may also be arranged to indicate the risk of prostate cancer (or another a disease) for an individual examined on the presence of a disease specific substance in the body of the individual. This may, for example, be a male who knows his serum PSA level with an interest in being informed about the chance of having prostate cancer. The diallers 3-6 may then for example represent diagnostic parameters such as age, PSA, direct rectal examination (DRE) and, optionally, one or more of the diagnostic parameters used to estimate the risk for individual not examined medically for the disease. The risk scale may then represent the probability of a positive lateralised sextant biopsy.

The device 1 may also be arranged to indicate the risk of a disease for an individual from which a tissue biopsy has been taken to determine the presence of the disease, and optionally which tissue biopsy did not reveal the disease. This may for example be a male who has undergone a prostate biopsy, without a prostate cancer being detected and interested in an estimation of the risk that, although tested negatively, he has prostate cancer. The diallers 3-6 may then for example represent diagnostic parameters such as PSA, prostatic volume, direct rectal examination (DRE), previous prostatic biopsy, or other parameters available and known to influence the risk after a tissue biopsy. The risk scale 20 may then represent the chance of having prostate cancer detected by lateralised sextant biopsy, and the chance of determination of potential parameters of cancer aggressiveness. The device 1 may also be arranged to indicate the risk of said disease being threatening for an individual diagnosed to have the disease. This may for example be a male who is diagnosed to have prostate cancer but who worries about the need of treatment, since treatment is an invasive procedure and most men die of other causes than prostate cancer. This risk analysis may for example include the general health status and parameters of tumour aggressiveness. PSA level, prostatic volume, malignancy grading of the biopsy (Gleason score), amount of tumour and amount of normal tissue in the biopsy and others. The risk scale 20 may then represent the probability of having an indolent/more aggressive prostate cancer, should treatment or active observation be indicated.

The device 1 can be used to allow assessment of the risk by an individual or by a clinician.

Figure 4:
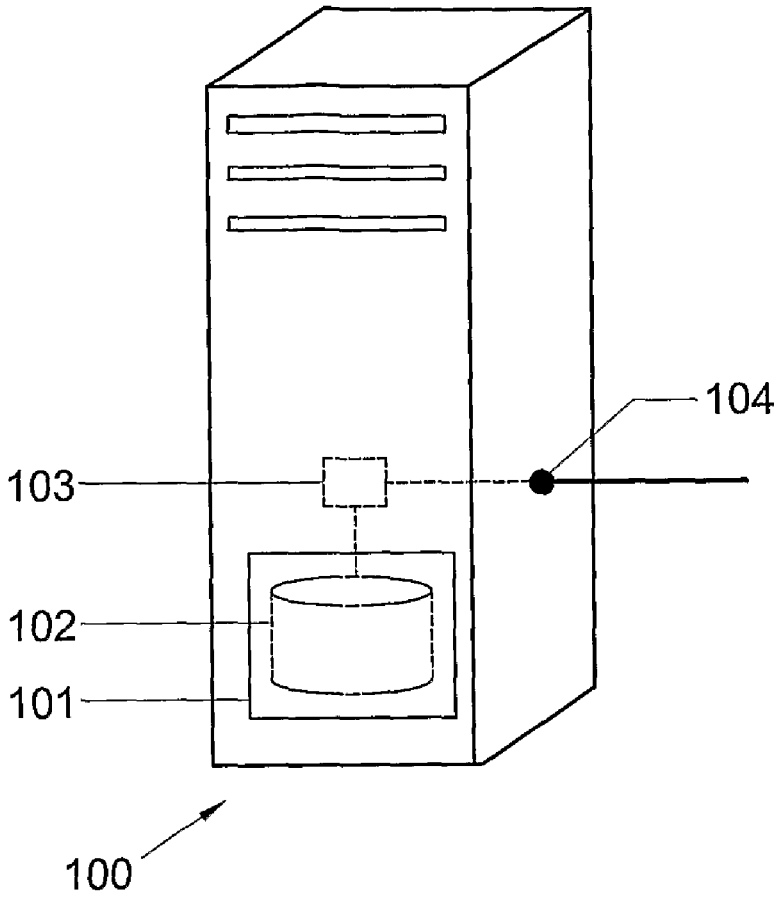
FIG. 4 schematically shows an example of an embodiment of a computer system with a data storage device according to the invention.

FIG. 4 shows a data storage device 101 comprising a memory 102 in which a collection of prostate cancer screening data is stored. In the example of FIG. 4, the data storage device is a part of a computer system 100. The computer system 100 may for example be a database server, in which case the collection is stored in the memory as a database, such as a relational database or other suitable type of database. In the memory 102 program code representing a database application may then be stored, which program code, when executed by a processor 103 of the computer system enables manipulation of the data in the database, e.g. via a suitable connection 104 to the processor 103.

The screening data may be obtained from a selection of the general male population after excluding pre-existing prostate cancer, without disease specific medical pre-selection. The selection of general male population may be a sample of a sub-section of the general male population, based on for example an age threshold. For instance, the data may be obtained from a survey amongst the general male population at least 55 years age old, and/or of age younger than 75 years. The data may be gathered from the selection of the general male population by separating the selection in a first group of men which will be subjected to a prostate cancer detection method and a second group of men not subjected to a prostate cancer detection method.

By way of non-limiting experiment, screening data has been obtained from a sample of the male population in the area of Rotterdam, the Netherlands. The screening data was sub-sampled to include man in the age range of at least 55 years and below 74 years. 42,369 men have been randomized between early detection measures and no-early detection measure for prostate cancer to be taken, of which 21,206 men were subjected to early detection measures. The participants were recruited from the population registry. The participation rate was slightly above 50%. Data were collected by an extensive intake questionnaire, as shown in table A, including family history, previous illnesses and many other aspects, such as the previous diagnosis of prostate cancer, previous examination of the prostate by the general practitioner or urologist, a previous blood test for prostate cancer, prior prostatic surgery, an enlarged prostate, an infection of the prostate (prostatitis), a sterilisation operation. Further more different degrees of family involvement are registered together with other prior illnesses. Complaints relating to the prostate are registered by use of the international prostate symptom score (IPSS).

For the early-detection group, in addition to the parameters taken for the non-early detection group, among others, information on ethnicity, urinary complaints, serum sampling for prostate-specific antigen (PSA) and the results of PSA determinations, date of and details on diagnostic procedures and indications for prostatic biopsy, complications of biopsy, information on treatment, treatment results and complete follow-up data in both randomisation groups with respect to the presence and management of prostate cancer. A complete registry of causes of death was also included. Prostate cancer deaths were confirmed by an independent Causes of Death Committee. Tissue and serum repositories have also been kept. Samples were registered in the database.

More specific, in the early-detection group, blood samples were taken and a PSA determination was performed Based on the determined PSA level, the early-detection group was separated into different screening groups. In case the determined PSA level was above a lower threshold value, in the experiment 3 ng/ml, and in the experiment, below a higher threshold value, higher than the lower threshold, of 4.0 ng/ml, a direct rectal examination (DRE) and a transrectal ultrasound examination (TRUS) were performed to determine abnormalities in the prostate. In case no abnormalities were found, the respective individual in this first screening group was re-screened after 4 years. It is found that the threshold value, avoids an increase of over diagnosis of cases that are like not to warrant detection and treatment.

In the first screening group, in case the determined PSA level was above or equal to the second threshold value of 4.0 ng/ml, DRE/TRUS and sextant biopsies where performed. Biopsies where also performed for the individuals with a determined PSA level between the lower and higher threshold value in case abnormalities in the prostate were found after the DRE and the TRUS. In case the biopsies revealed a benign result, the respective individual in this second screening group was re-screened after 4 years.

In case the biopsies revealed a malignant result, the respective individual in this second screening group was referred to his general practitioner and results of the subsequent treatment were measured and stored separately in order to evaluate the comparability of pathologic characteristics and treatment and to study the disease specific mortality.

In case the determined PSA level was below the threshold value of 3 ng/ml, no further examination was performed, and the respective individual in this second screening group was re-screened after 4 years.

TABLE A

| List of variables in intake questionaire | |
|---|---|
| General Information: | |
| Hospital ID | Linked to personal information: name, adress etc. |
| ERSPC ID | Auto number |
| Date of birth | |
| Randomisation status | "S" or "C" (time randomisation) |
| Date of randomisation | |
| Protocol number | To indicate changes in the screening protocol |
| Visit date | |
| Visit number | To discriminate between initial and second visit |
| Questionnaire: | |
| Prostate examined? | |
| If Yes, when? | Year of last examination |
| PSA determination? | |
| If Yes, when? | Year of last examination |
| Prostate operation (TURP)? | |
| If Yes, when? | Year of operation |
| BPH diagnosis? | |
| If Yes, when? | Year of diagnosis |
| Prostatitis? | |
| If Yes, when? | Year of diagnosis |
| Prostate Cancer? | |
| If Yes, when? | Year of diagnosis |
| Vasectomy? | |
| If Yes, when? | Year of operation |
| Prostate cancer in family? | Three fields with possible relatives |
| Cardiac diseases? | Y/N, cardiac valve info is asked, profylaxe! |
| Diabetes? | Y/N, important for profylaxe! |
| High bloodpressure? | Y/N |
| Other diseases? | description |
| Other cancers? | description |
| Medicine use? | Description, extra attention for anticoagulentia |
| Experience of health? | Bad, moderate, good |
| IPSS | 8 separate questions. |
| Sreening data: | |
| Data concerning DRE: | |
| Physician code | Code for name |
| Result of DRE | Benign, Malignant: distinction between left, right or both sides |
| Estimated weight | Grammes. |
| Clinical stage assessed by DRE | TNM classification |
| Localisation of malignant area | Prostate is divided in areas coded by lettes and numbers. |
| Remarks | Text field for indication of stones, cysts etc. |
| Data concerning TRUS: | |
| Tape number and count | |
| Result of TRUS | See above |
| Diameter of lesion (largest) | millimeter |
| Clinical stage assessed by TRUS | TNM classification |
| Localisation of lesions | See above |
| Measurements of prostate | Width, height, lenght, area, prm and total volume (mm and cc) |
| Measurements of transition zone | See above |
| Remarks | Text field for indication of stones, cysts etc. |
| Screening results: | |
| PSA | ng/ml |
| Number of sample storage (−70 C.) | |
| Remarks | Text field. |
| Conclusion after PSA, DRE, TRUS | Codes: 4, B, U, M, V (normal recall, biopsy done, refusal after PSA, no biopsy possible due to medication, biopsy done result pending) |
| Clinical Stage | Overall clinical stage, the most malignant stage from DRE/TRUS |
| Conclusion after biopsy | Codes: 4, K (benign -> normal recall, cancer) |
| Date of next screening | |
| Complications after biopsy: | |
| Haematuria | Y/N |
| Haemospermia | Y/N |
| Fever (>38 C.) | Y/N |
| Pain | Y/N |

TABLE A-continued

| List of variables in intake questionaire | |
|---|---|
| Hospital admission required | Y/N |
| Additional medication required | Y/N |
| Description of medication | |
| Age at visit | Calculated. |
| Data of sextant biopsies | |
| Hospital ID | |
| ERSPC ID | |
| Protocol number | |
| Visit date | |
| Visit number | |
| Biopsy date | |
| Physician code | |
| Seventh biopsy in lesion? | Y/N |
| 10 fields per biopsy | Coding for: C, X, H. (Cancer, X = high grade cancer, H = High grade PIN, L = Low grade PIN) |
| Gleason score 1 | |
| Gleason score 2 | |
| Anderson score | |
| Extracapsular invasion | |
| Vesicula invasion | |
| Perison | |
| Anison | |
| Polymorpism | |
| Diagnosis (3 fields) | Coding for: PC, DM, HP, LP, PR, AT, BH, GA, IM (Prostate Cancer, Dubious Malignant, High Grade PIN, Low grade PIN, Prostatitis, Atrophy, benign Hyperplasia, No Malignancy, Inadequate Material) |
| All fields are twice in the database for repeated biopsy in case of DM or HP. | |

Based on the obtained screening data, a method for determining a dependency of the risk for prostate cancer on at least one diagnostic parameter was performed. From data in the memory of the data storage device, at least one diagnostic parameter and a relationship between a value of the diagnostic parameter and the risk were determined. were determined. Statistical models were used which consider combinations of risk factors in multivariable analyses. Examples of methods include survival analyses, regression analyses, for example logistic and Cox regression, classification and regression trees, and neural network analysis.

Using the results of such a method, a device for indicating a risk for prostate cancer may be manufactured. The device may include at least one input for entering a value of a diagnostic parameter and a risk determination unit arranged to determine the risk based on a relationship between a value of the diagnostic parameter and the risk. Such a device may for example be implemented as shown in FIG. 1 or in any other suitable manner.

In the foregoing specification, the invention has been described with reference to specific examples of embodiments of the invention. It will, however, be evident that various modifications and changes may be made therein without departing from the broader spirit and scope of the invention as set forth in the appended claims. For instance, in the examples of FIG. 1 more or less diallers may be present and/or other diagnostic parameters may be used. Furthermore, the data storage device may be implemented in any manner suitable for the specific implementation and for example include a hard-disk, an optical data disc such as a CD or DVD, a flash memory or any other element in which data can be stored. However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage.

The invention claimed is:

1. A device for indicating a risk for a disease of an individual, comprising:

an indicator for indicating a determined value for said risk; said indicator comprising a risk scale representing a range of values of said risk, said indicator including a larger annular sheet-like body enclosing an inner disk-shaped area in which at least two smaller annular sheet-like bodies are present, and at least two diallers for entering values of diagnostic parameters of an individual, a first one of said diallers comprising a parameter scale representing a range of values of a first one of said diagnostic parameters, said first dialler including a first one of said at least two smaller annular sheet-like bodies and enclosing an inner disk-shaped area in which at least one smaller annular sheet-like body is present, and a second one of said diallers comprising a parameter scale representing a range of values of a second one of said diagnostic parameters, said second dialler including a second one of said at least two smaller annular sheet-like bodies, said annular sheet-like bodies being rotatable with respect to each other around a central axis of said second one of said at least two smaller annular sheet-like bodies for selecting said parameter values, and said diallers being movable with respect to said indicator such that when a parameter value on said first parameter scale is selected, an associated first risk value is indicated on said risk scale according to a predetermined mathematical relationship and when, additionally, a parameter value on said second parameter scale is selected, a second risk value associated to a combination of said first and second parameter values is indicated on said risk scale according to a predetermined mathematical relationship.

2. A device according to claim 1, wherein said disease comprises prostate cancer, bladder cancer, kidney cancer, and/or other urological malignancies.

3. A device according to claim 1, wherein said diagnostic parameters comprise one or more of the group consisting of: age, family history of the disease, diet, smoking habits, skin colour (black versus Caucasian race), weight, weight change and a parameter associated with defecation and/or urination.

4. A device according to claim 1, wherein said diagnostic parameters comprise a blood parameter such as a tumor associated protein concentration, the volume of the prostate determined by ultrasound, a biopsy parameter and/or manual probing parameter.

5. A device according to claim 4, wherein said diagnostic parameters comprise a tumor associated protein concentration, said tumor associated protein comprising PSA.

6. A device according to claim 4, wherein said risk is an indication for the risk of the occurrence of a variety of said disease, such as an aggressive or a non-aggressive cancer.

7. A device according to claim 1, wherein said diagnostic parameters comprise a parameter indicative of an outcome of an analysis of a tissue biopsy.

8. A device according to claim 1, wherein said indicator includes a sheet-like body provided with a human perceptible marking and wherein said at least two diallers are slidable or rotatable with respect to said marking.

9. A method for indicating a risk for disease on the basis of a diagnostic parameter comprising: providing a device comprising an indicator for indicating a determined value for said risk; said indicator comprising a risk scale representing a range of values of said risk, said indicator including a larger annular sheet-like body enclosing an inner disk-shaped area in which at least two smaller annular sheet-like bodies are present, and at least two diallers for entering values of diagnostic parameters of an individual, a first one of said diallers comprising a parameter scale representing a range of values of a first one of said diagnostic parameters, said first dialler including a first one of said at least two smaller annular sheet-like bodies and enclosing an inner disk-shaped area in which at least one smaller annular sheet-like body is present, and a second one of said diallers comprising a parameter scale representing a range of values of a second one of said diagnostic parameters, said second dialler including a second one of said at least two smaller annular sheet-like bodies, said annular sheet-like bodies being rotatable with respect to each other around a central axis of said second one of said at least two smaller annular sheet-like bodies for selecting said parameter values, and said diallers being movable with respect to said indicator such that when a parameter value on said first parameter scale is selected, an associated first risk value is indicated on said risk scale according to a predetermined mathematical relationship and when, additionally, a parameter value on said second parameter scale is selected, a second risk value associated to a combination of said first and second parameter values is indicated on said risk scale according to a predetermined mathematical relationship, at least one of said diagnostic parameters and a combination of said diagnostic parameters being associated to said risk according to a prediction model, and determining a first value of said first one of said diagnostic parameters in said prediction model, making a first prediction about said risk based on said first determined value in accordance with said prediction model;

determining a second value of the second one of said diagnostic parameters in said prediction model, and making a second prediction about said risk based on said second value and said first prediction.

10. A method according to claim 9, wherein the prediction model has been calculated from a collection of prostate cancer screening data obtained from a selection of the general male population without medical pre-selection.

11. A method according to claim 10, wherein said selection consists of men with an age of at least 55 years and/or with an age of 75 years or less.

12. A method according to claim 10, wherein said selection consists of a first group of men subjected to a prostate cancer detection method and a second group of men not subjected to a prostate cancer detection method.

13. A method according to claim 10, wherein the prediction model includes said screening data.

* * * * *